US005202665A

United States Patent [19]

Hafele

[11] Patent Number: 5,202,665

[45] Date of Patent: Apr. 13, 1993

[54] TEMPERATURE SENSOR AND PROCESS FOR ITS PRODUCTION

[75] Inventor: E. Hafele, Karlsruhe, Fed. Rep. of Germany

[73] Assignee: Roth-Technik GmbH & Co., Gaggenau, Fed. Rep. of Germany

[21] Appl. No.: 671,920

[22] PCT Filed: Jul. 13, 1990

[86] PCT No.: PCT/DE90/00527

§ 371 Date: Mar. 22, 1991

§ 102(e) Date: Mar. 22, 1991

[87] PCT Pub. No.: WO91/01561

PCT Pub. Date: Feb. 7, 1991

[30] Foreign Application Priority Data

Jul. 25, 1989 [DE] Fed. Rep. of Germany ..... 3924518

[51] Int. Cl.[5] ..... H01C 3/04

[52] U.S. Cl. ..... 338/25; 338/308; 156/89; 427/101

[58] Field of Search ..... 338/25, 308, 309; 156/89; 374/185; 427/101

[56] References Cited

U.S. PATENT DOCUMENTS 4,805,296 2/1989 Jinda et al. ..... 338/25 X
4,906,968 3/1990 Gershenfeld et al. ..... 338/25
5,010,315 4/1991 Fedter et al. ..... 338/25 X

FOREIGN PATENT DOCUMENTS 2006521 5/1979 United Kingdom .
2120453 11/1983 United Kingdom .

*Primary Examiner*—Marvin M. Lateef
*Attorney, Agent, or Firm*—Tarolli, Sundheim & Covell

[57] ABSTRACT

The invention relates to a temperature sensor with platinum of temperature-sensitive material, and a process for the production of such a temperature sensor. The problem of the invention is to provide a miniaturized temperature sensor as small as possible which can be used at temperatures of 600° C. to over 1,000° C. For solution, the invention proposes a temperature sensor in which the layer contains finely divided metal platinum in oxide ceramic. Production takes place by mixing together platinum powder, oxide and binder, and after supplying the layer on the support substratum, tempering with this latter.

12 Claims, 1 Drawing Sheet

TEMPERATURE SENSOR AND PROCESS FOR ITS PRODUCTION

TECHNICAL FIELD

The invention relates to a temperature sensor with a temperature-sensitive layer containing platinum placed on a support substratum, as well as a process for the production of a temperature sensor in which a layer containing platinum is placed on a support substratum.

BACKGROUND ART

Temperature sensors having a temperature-sensitive element with platinum are known which are produced in thin-film technology in which platinum on a support substratum is diffused in layers of a few atoms. In maintaining a corresponding geometric structure such as meander form, there may be obtained with thin enough layers of a few atom layers a high enough ground resistance which, for such a temperature sensor, must lie in the range of 100 ohms. These thin-film sensors can only be used at lower temperatures in the range up to 400° C., and below 600° C. in any case since platinum vaporizes at higher temperatures. By this alone, there is a considerable change of resistance so that no reproducible results are longer possible because of the layer thickness of only a few atom layers.

Platinum wires have also been used as temperature sensors. To reach the large enough ground resistance, the wire would have to have a considerable length which even with winding in coil form would lead to a sensor with considerable outer dimensions which cannot be used in many areas where there is miniaturizing. Thick-layer pastes containing platinum are also known which have organic binders and solvents as other components. These are used as thick-film heating elements and reach their sufficient resistance based on the length of the heating element, and are used for pressure-setting temperatures usual in heating. Aside from the low specific resistance which would also lead only to very large sensor elements, these could not be used at temperatures higher than 600° C. since there would no longer be reproducibility. In both cases, it is true that platinum is in a red glow from about 800° C., but can no longer be used as a temperature sensor.

The applicant has found that no miniaturized temperature sensors are known for high temperature uses. Thermo elements which work with thermovoltages are used. A disadvantage here is that a definite surrounding temperature must be used as a reference temperature or a microprocessor be used. Such temperature coolers are expensive.

SUMMARY OF THE INVENTION

The invention, therefore, addresses the problem of providing a sensitive high-temperature sensor stable with time in miniaturized design which can be used in a versatile way.

According to the invention, the problem is solved by a temperature sensor distinguished by the fact that a layer in ceramic oxide contains finely divided metallic platinum. For the production of such a temperature sensor according to the invention, there is proposed a process which is distinguished by the fact that platinum powder, oxides and binder are mixed together, and after applying the layer on the support substratum tempered with the latter.

The temperature-sensitive layer of the temperature sensor according to the invention may have between 60 and 90% by weight metallic platinum, and is preferably distinguished by the fact that it contains platinum in a proportion of about 70 to 85% by weight. As the oxide part, preferably a mixture of silicon, aluminum and alkaline earth oxide, especially calcium oxide, is used. The aluminum oxide part is provided by the fact that, as a rule, the support substratum is aluminum oxide. In the case that the support substratum consists of another oxide, the aluminum oxide might be replaced by the material of the corresponding support substratum. Based on tempering, silicon oxide provides a quartz or vitreous nature, and forms an inert material which is especially suitable for the desired high temperature uses. As an alkaline earth oxide, calcium oxide is preferable. Instead of this, strontium and barium oxides may be used, but calcium oxide has proved more stable. The oxide mixture forms a eutectic of which the melting point is set by adding alkaline earth oxide and, in particular, can be reduced, while a mixture of aluminum oxide and silicon oxide provides a relatively high melting point which lies above the vaporization point of platinum so that no heating could take place up to this point. Through the addition of calcium oxide, the melting point of the eutectic mixture is reduced below the vaporization point of platinum so that the tempering can take place up to the desired melting point of the oxide mixture at which the desired quartz-like or vitreous compact consistency of the material is reached. In this way, the temperature-sensitive layer of the temperature sensor is preferably of a composition such that in the oxide mixture, silicon oxide is present in a range of 40 to 55% by weight, aluminum oxide in the range of 25 to 40%, and the rest alkaline earth oxide. Very preferably, silicon oxide is at 45 to 50% by weight, aluminum oxide is at 30 to 35% by weight, and the rest alkaline earth oxide. In particular, the oxide mixture contains 18 to 20% by weight alkaline earth oxide and the rest silicon oxide and aluminum oxide. To obtain as great as possible a reduction of the melting point of the eutectic oxide mixture, the invention provides that the temperature-sensitive layer is burned on the support substratum while, in particular, the temperature-sensitive layer has a compact vitreous morphology. An ideal oxide mixture is explained in the figure description which follows. Through the proportion of platinum and oxide component in the temperature-sensitive layer, its specific electric resistance is determined. It should be noted that the platinum part is not so far reduced that the necessary conductivity is completely broken or can be broken in use. To this extent, it has proved advantageous that platinum should have a part in the temperature sensitive layer of 80% by weight and based on the total mixture itself between 60 and 80% by weight. Accordingly, in processing, the oxide mixture is used in a proportion of 14 to 20% by weight in the total mixture of platinum paste, oil and thinner. In a preferred embodiment, it is provided that platinum paste with 65 to 70% by weight, oil and thinner with 5 to 10% by weight in each case, and the rest oxide are mixed together. The platinum part of the paste itself is preferably 75% by weight. A preferred definite total composition of the thick layer-pressure means according to the invention can also be seen from the figure description.

While the maximum temperature of tempering should remain below the vaporization temperature of platinum, and preferably below 1,400° C., a preferred embodiment provides for a maximum temperature of 1,300° to 1,350° C.

In a further development, it is provided that in the range from 300° to 400° C. a holding time be held for the complete combustion for the organic binder part of the layer. The holding time serves to produce the desired compact vitreous consistency of the temperature sensitive layer of the temperature sensor to be produced. The maximum holding time is not critical per se, but must not be unduly drawn out since in this way, besides the desired morphological changes leading to the compact vitreous consistency, changes of the platinum basic structure based on sinter effects may occur. This would lead to undesired larger structures or plaster formation, possibly also to oxidation, and to a breaking up of the platinum surface. Therefore, preferably, a holding time of 20 to 40 minutes should be sought, while a time of 25 minutes has proved an ideal value.

The uniform, not-too-steep temperature rise and fall is necessary in that the temperature-sensitive layer during the tempering process must not be exposed to any jumps of temperature since this could lead to damage such as brittleness and cracks. Accordingly, a temperature control with a temperature coefficient of 10° to 15° C. per minute, and especially 13° C. per minute above approximately 1,100° C. has come out. While this concerns as to fall, the temperature conduction on the heating element of the sinter oven because of its design can show a total slow temperature fall.

When a binder, especially organic (which as a rule are cellulose derivatives) containing platinum paste is used, it is advantageous in the zone of temperature rise at 300° to 400° C., especially at 350° C., to provide a holding time also in which the temperature is held over a given time at a definite value, while the maximum duration of the holding time is limited finally only by economic requirements. The holding time to obtain a perfect result should not be too short, especially not less than five minutes. Ten minutes have proved an ideal value. When such a holding time has been used, the tempered layer has a typical bright quartz ceramic color, while with too short a holding time there is a darkening of the color, even to blackening. This is because the organic binder consumes only slowly, and with insufficient holding time in the temperature zone is not fully burned to $CO_2$, but rather, carbon components remaining behind which could also have a negative effect on the temperature-sensitive properties of the layer.

In all through the invention, a miniaturized temperature sensor is provided which can preferably be used at temperatures of over 600° C. up to 1,200° C. The temperature sensor according to the invention can be made economically, and in particular, can also be applied in common and together with other functional elements such as oxygen sensors which are made in the same technology and heat conductors on a common substratum. Thus, one preferred embodiment provides that an oxygen sensor as well as a heat conductor regulated temperature-sensitive layer are placed on the substratum, and in further development, that the heat conductor is placed on the area of the support substratum bearing the oxygen sensor and the temperature-sensitive layer. In particular, the production of the sensor according to the invention is cheaper than the thin-film technology, aside from the fact that no high-temperature bearing sensors can be prepared in that way. No vacuum and no expensive apparatus are necessary. Also, the effect of temperature measurement results on complicated devices such as surrounding measurement sensors necessary in measurements by thermovoltage, and additional electronics are not needed. Rather, the sensor output is used directly for the regulation of a heat conductor, for example.

The above combination is used especially for raw oxygen measurement, for example in gas power plants or in processing technology in the chemical industry, when the residual oxygen content is measured with a view to making it inert. The lambda value measurement takes place based on a solids effect, with reduction or oxidation, depending on the oxygen content of the surrounding gas. While this solids effect is only used at higher temperatures, especially those above 600° C., the temperature sensor must be heated to this temperature and must be held with great accuracy at the prescribed temperature, for which the temperature sensor according to the invention can be used ideally. Other fields of use are high-temperature ovens, sinter ovens, etc.

BRIEF DESCRIPTION OF THE DRAWINGS

Other advantages and features of the invention are given from the claims and from the description which follows, in which one embodiment is explained in detail with reference to the drawings.

DESCRIPTION OF A PREFERRED EMBODIMENT

Figure 1:
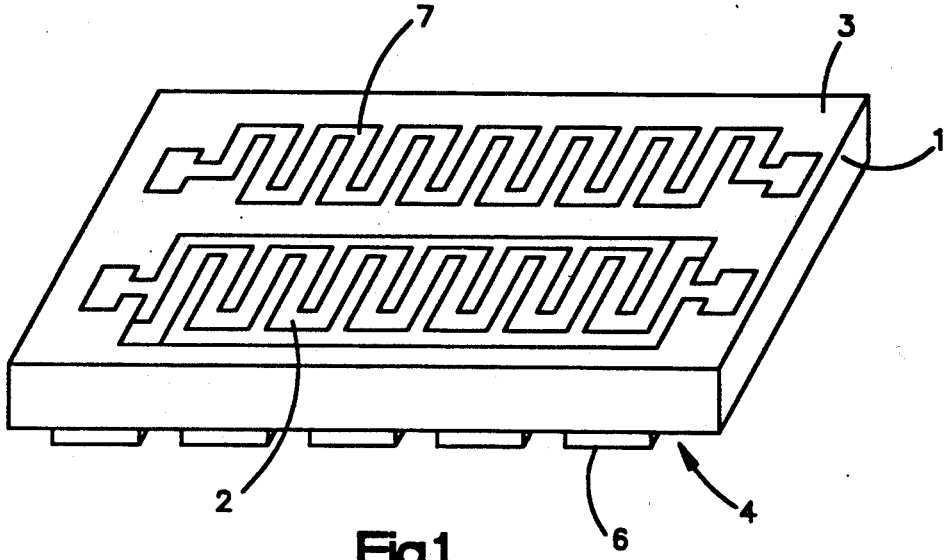
FIG. 1 shows a preferred design of a temperature sensor according to the invention.

Oxygen sensors for lambda measurement such as, for example, in gas power plants, processing technology, etc., show their highest sensitivity based on an oxidation-reduction solids effect corresponding to the oxygen present at higher temperatures. Therefore, they must be heated to higher temperatures, and since the effect is temperature-dependent, must be stabilized at a prescribed temperature. For this, the oxygen or gas sensor 2 known per se may be placed on a substratum or support 1 such as one of aluminum oxide. On the surface 4 of the support opposite the surface bearing the oxygen sensor 2 is placed a heat conductor 6 which may be, for example, a heat conductor on a ceramic basis. Also, near the oxygen sensor 2 is placed a temperature sensor 7 on the surface 3 of the support 1 as described below. The temperature sensor 7 is led in meander form and in the composition given below, a total length of 10 mm, a width of 3 mm, a total "wire length" of 60 to 70 mm, and a layer thickness of 10 to 15 micrometers, and a width of 250 micrometers.

The temperature sensor 7 consists of a ceramic (preferably largely "vitrified" based on the tempering process) oxide, and pure metal platinum dispersed in the latter in a proportion of 80% by weight. The oxide composition, according to a preferred embodiment, is 50% by weight silicon oxide, 30% by weight aluminum oxide and 20% by weight calcium oxide. The ground resistance of the temperature sensor 7 so described is about 100 ohms.

The temperature sensor 7 is produced on the support substratum 1 as follows:

First, platinum powder and oxide are mixed in the desired final proportion of 80 to 20% by weight. Then a paste of 65% by weight platinum and oxide powder and 35% by weight vehicle is prepared. The vehicle consists of 70% by weight of an organic binder such as methyl cellulose and 30% by weight of an organic solvent such as dibutylcarbitolacetate.

Then the paste obtained in this way is pressed, in screen pressure and thick-film technology, onto the support substratum of aluminum oxide in the desired geometric form such as the meander form shown.

Figure 2:
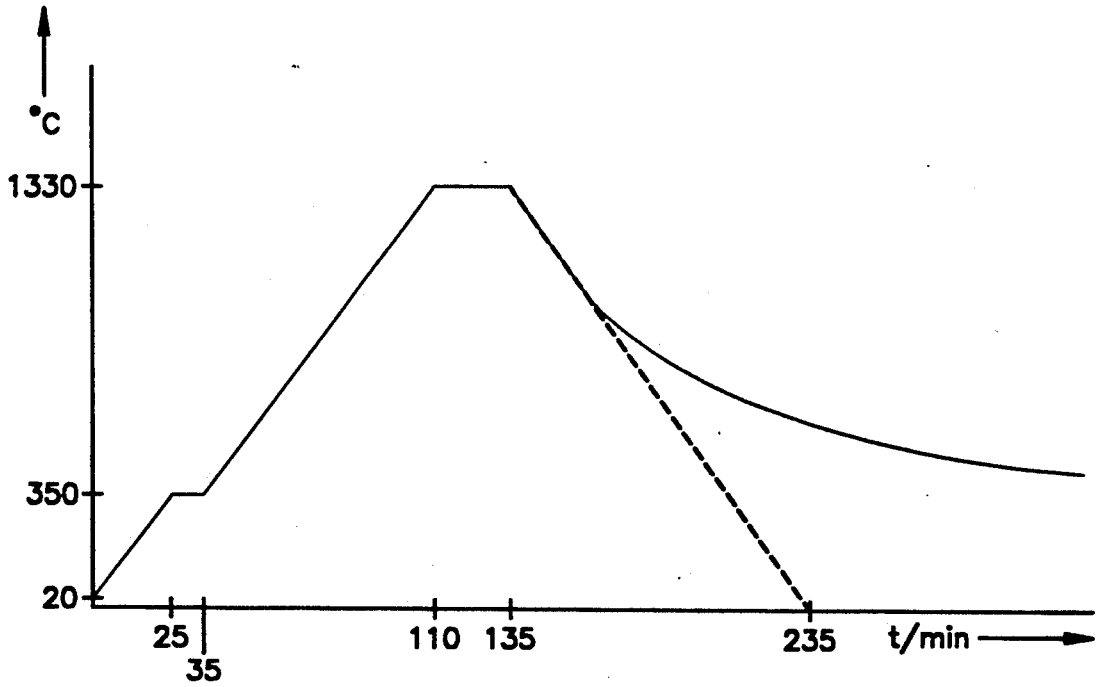
FIG. 2 shows a preferred temperature conduction in the tempering process for production of the temperature sensor.

Then a tempering is carried out in which the support 1 and printed temperature sensor substratum is heated in a tempering oven from room temperature (20°), with a differential temperature rise of about 13° C. per minute, to about 350° C. Above their vaporization temperature, solvent, thinner and oil evaporate. From about 100° C., the pressure mass, at first viscous, is a nearly solid mass since the fluid parts are largely burned away. Then the organic binder which is a cellulose derivative begins to burn. Since the organic binder burns slowly, the temperature is held constant at about 350° for about 10 minutes to make possible a complete combustion (conversion into $CO_2$) of the organic binder. It was found that without or with insufficient holding time, the oxide ceramic obtained is black or dark because of incompletely burned binder, while with a sufficient holding time in the temperature range, the ceramic finally obtained has the typical light color. Incompletely burned binder might also impair the properties of the temperature sensor. After the holding tine, shown in FIG. 2 at a temperature of 350° C., there is another temperature rise with the same temperature coefficient up to the desired final or maximum burning-in temperature of about 1,330° C. It has been found that the temperature rise is a critical value. With steeper temperature rise, hair cracks appear in the sensor layer. A flatter temperature rise is quite possible, but this means longer production time and thus a higher production expense and higher costs. The temperature conduction provided represents an optimization, therefore, while assuring a perfect result.

The burning-in temperature of 1,330° C. can be maintained for a certain time, given in the embodiment at 25 minutes This is necessary in order to attain a settling of the layer, and thus a change of the morphology (while retaining the structure) and, on the whole, a vitreous compact layer which assures a uniform conductivity. It should be noted that the burning-in temperature must not be maintained too long since inner structure changes will then take place. In particular, platinum bridges will be interrupted, and thus the electric contact passing through will be damaged, whether because of typical sinter effects in the form of formation of coarser structures or plaster forming, or by oxidation of plate particles. With a view to the desired compact vitreous consistency, while the holding time at burning-in temperature can hardly be shortened, a certain extension is not critical since the above-mentioned bad effects only occur with excessively long burning-in time. Also, it is a real optimization that the holding time of the burning-in temperature has been kept as short as possible, while it is assured that the desired compact vitreous structure is attained. There is also a reduction of temperature with the same temperature coefficient on the heating element, and thus the same temperature conduction. Because of the oven's own cooling behavior, the temperature, as shown, cools more slowly in the oven. A cooling of the temperature with the temperature coefficient to about 1,100° C. is important. It need not be chosen any more strongly, since otherwise damage to the structure obtained might occur.

In all, there is provided according to the invention a temperature sensor with a sufficiently great ground resistance in the given range, which is resistant to high temperature and especially at temperatures of over 600° C. to far above 1,000° C. for temperature measurement, and thus, in the embodiment shown in FIG. 1, can be used for the temperature control of the heater 6.

This invention has been described with reference to a preferred embodiment. Modifications and changes may become apparent to one skilled in the art upon reading and understanding this specification. It is intended to cover all such modifications and changes within the scope of the appended claims.

Having described a preferred embodiment of the invention, I claim:

1. A temperature sensor with a temperature-sensitive layer containing platinum applied on a support substratum, with the distinction that the layer contains finely divided metallic platinum in oxide ceramic and with the distinction that the layer contains metallic platinum in a proportion of 60 to 90% by weight.

2. Sensor according to claim 1, with the distinction that the oxide part of the temperature sensitive layer (7) is an oxide mixture of silicon, aluminum and alkaline earth oxides, especially calcium oxide.

3. Sensor according to claim 2, with the distinction that in the oxide mixture, silicon oxide is present in a range from 45 to 50% by weight, aluminum oxide 30 to 35% by weight, and the rest is alkaline earth oxide.

4. Sensor according to claim 3, with the distinction that the oxide mixture contains 18 to 20% alkaline earth oxide, and the rest silicon oxide and aluminum oxide.

5. Sensor according to claim 1, with the distinction that the temperature-sensitive layer (7) is burned on the support substratum (1).

6. Sensor according to claim 1, with the distinction that the temperature-sensitive layer (7) has a compact, vitreous morphology.

7. Sensor according to claim 1, with the distinction that on the support substratum (1) are placed an oxygen sensor (2) as well as a heat conductor (6) regulated by the temperature-sensitive layer (7).

8. Sensor according to claim 7, with the distinction that the heat conductor (6) is placed on the surface (4) of the support substratum (1), turned away from the surface (3) bearing the oxygen sensor (2) and the temperature-sensitive layer (7).

9. A process for the production of a temperature sensor in which a layer containing platinum is placed on a support substratum, with the distinction that platinum powder, oxide and binder are mixed together by screen pressure and thickfilm technology, and after applying the layer on the support substratum, tempered with the latter up to temperatures between 1,300° and 1,350° C., the oxide part being a silicon, aluminum and alkaline earth oxide mixture, the oxide mixture including silicon oxide in a range from 45 to 50% by weight, aluminum oxide 30 to 35% by weight, and the rest calcium oxide (based on the total oxide weight).

10. A process for the production of a temperature sensor in which a layer containing platinum is placed on a support substratum, with the distinction that platinum powder, oxide and binder are mixed together by screen pressure and thickfilm technology, and after applying the layer on the support substratum, tempered with the latter up to temperatures between 1,300° and 1,3500° C., the oxide part being a silicon, aluminum and alkaline earth oxide mixture, the oxide mixture including an oxide part of 18 to 20% alkaline earth oxide, and the rest silicon oxide and aluminum oxide (based on the total oxide weight).

11. A process for the production of a temperature sensor in which a layer containing platinum is placed on a support substratum, with the distinction that platinum powder, oxide and binder are mixed together by screen pressure and thickfilm technology, and after applying the layer on the support substratum, tempered with the latter up to temperatures between 1,300° and 1,350° C., oxide being used in a proportion of 14 to 20% by weight, based on the total weight of the mixture.

12. A process for the production of a temperature sensor in which a layer containing platinum is placed on a support substratum, with the distinction that platinum powder, oxide and binder are mixed together by screen pressure and thickfilm technology, and after applying the layer on the support substratum, tempered with the latter up to temperatures between 1,300° and 1,350° C., platinum paste with 65 to 70% by weight, oil and thinner with 5 to 10% in each case, and the rest oxide being mixed together.

* * * * *